US006237580B1

(12) United States Patent
DeGroot et al.

(10) Patent No.: US 6,237,580 B1
(45) Date of Patent: May 29, 2001

(54) PURGE FUELING DELIVERY BASED ON DYNAMIC CRANKSHAFT FUELING CONTROL

(75) Inventors: Kenneth P. DeGroot, Macomb Township; Mark J. Duty, Davison; Gregory T. Weber, Commerce Township, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/377,320

(22) Filed: Aug. 19, 1999

(51) Int. Cl.[7] ..... F02B 75/08
(52) U.S. Cl. ..... 123/698; 123/436; 123/520
(58) Field of Search ..... 123/436, 520, 123/698

(56) References Cited

U.S. PATENT DOCUMENTS

| | | | | |
|---|---|---|---|---|
| 4,245,592 | | 1/1981 | Atkins, Sr. . | |
| 4,703,736 | | 11/1987 | Atkins, Sr. . | |
| 4,821,701 | | 4/1989 | Nankee, II et al. . | |
| 5,002,596 | | 3/1991 | Moskaitis et al. . | |
| 5,005,550 | | 4/1991 | Bugin, Jr. et al. . | |
| 5,024,687 | | 6/1991 | Waller . | |
| 5,263,460 | | 11/1993 | Baxter et al. . | |
| 5,495,749 | | 3/1996 | Dawson et al. . | |
| 5,634,868 | | 6/1997 | Weber et al. . | |
| 5,641,899 | | 6/1997 | Blomquist et al. . | |
| 5,651,349 | | 7/1997 | Dykstra et al. . | |
| 5,682,869 | | 11/1997 | Nankee, II et al. . | |
| 5,720,260 | * | 2/1998 | Meyer et al. | 123/436 |
| 5,746,187 | * | 5/1998 | Ninomiya et al. | 123/698 |
| 5,809,969 | | 9/1998 | Fiaschetti et al. . | |
| 5,950,603 | * | 9/1999 | Cook et al. | 123/436 |
| 6,039,032 | * | 3/2000 | Morikawa et al. | 123/698 |
| 6,085,734 | * | 7/2000 | DeGroot et al. | 123/436 |
| 6,102,003 | * | 8/2000 | Hyodo et al. | 123/436 |

* cited by examiner

*Primary Examiner*—John Kwon
(74) *Attorney, Agent, or Firm*—Donna L. Berry

(57) ABSTRACT

A fuel control system is provided for enhancing the fueling strategy of a vehicle at start up when fueling is being supplemented with purge vapors from the fuel tank. The system includes monitoring the purge vapor flow rate from the purge vapor control system to the engine at start-up. A dynamic crankshaft fuel control fuel multiplier is then calculated based on engine roughness. If the engine is operating rough during purge vapor fueling, the amount of injected fuel is adjusted according to the fuel multiplier. Once oxygen sensor feedback is available, the dynamic crankshaft fuel control fuel multiplier is recalculated based on the oxygen sensor goal voltage. If necessary, the amount of injected fuel may be readjusted with the updated fuel multiplier. Once the engine is warm, the purge vapor fueling stops and the present methodology ends.

14 Claims, 1 Drawing Sheet

PURGE FUELING DELIVERY BASED ON DYNAMIC CRANKSHAFT FUELING CONTROL

BACKGROUND OF THE INVENTION

1. Technical Field

The present invention generally relates to fuel control systems and, more particularly, to a method of using a dynamic crankshaft fuel control fuel multiplier to control fuel injection in conjunction with the delivery of fuel vapors from a fuel tank to an engine during cold engine operation.

2. Discussion

Modern automotive vehicle engines commonly employ injected fuel for combustion. At start-up, when the engine is not fully warm, the injected fuel is commonly cold and in a liquid state. Cold, liquid fuel is not as easily vaporized as warm fuel. As such, the cold, liquid fuel poorly combusts at start-up. This may lead to poor emissions.

Attempts have been made before and after combustion to improve emissions quality. One pre-combustion treatment has been to heat the fuel prior to its injection. By heating the fuel, it becomes more easily vaporized thereby improving its combustibility. While successful, such pretreatment heating is complex and expensive to implement. A common post-combustion treatment involves the employment of a catalyst in the engine exhaust gas stream. The catalyst burns the undesirable exhaust gas constituents prior to their passage to the atmosphere. While also successful, such post-combustion treatment is still expensive and complex to implement.

Modern automotive vehicles are also commonly equipped with a fuel vapor purge control system. Fuel within the fuel tank tends to vaporize as temperatures increase. The vaporized fuel collects in the fuel tank and is periodically removed by the purge vapor control system. The fuel vapors from the tank are initially collected and stored in a canister. When the engine operating conditions are conducive to purging, a purge valve is opened thereby allowing the engine to draw the fuel vapors from the purge canister to the engine for combustion.

While such purge fuel vapor control systems are very efficient, some fuel vapor is commonly present in the dome portion of the fuel tank at start-up. Advantageously, it has recently been discovered that this fuel vapor can be used for combustion during cold engine operation instead of the liquid fuel normally supplied from the fuel injectors. In this process, fuel vapor from the fuel tank is delivered to the engine at start-up while a commensurate amount of normally injected fuel is simultaneously removed from the fueling strategy. As such, the total amount of fuel delivered, i.e., fuel vapor plus injected fuel, is controlled.

However, prior to the present invention, there was no way to optimize the amount of injected fuel in the purge vapor start-up fueling strategy for providing smooth engine operation. As such, the potential for rough engine operation exists.

SUMMARY OF THE INVENTION

A fuel control system is provided for enhancing the fueling strategy of a vehicle at start-up when fueling is being supplemented with purge vapors from the fuel tank. The system includes monitoring the purge vapor flow rate from the purge vapor control system to the engine at start-up. A dynamic crankshaft fuel control fuel multiplier is then calculated based on engine roughness. If the engine is operating rough during purge vapor fueling, the amount of injected fuel is adjusted according to the fuel multiplier. Once oxygen sensor feedback is available, the dynamic crankshaft fuel control fuel multiplier is recalculated based on the oxygen sensor goal voltage. If necessary, the amount of injected fuel may be readjusted with the updated fuel multiplier. Once the engine is warm, the purge vapor fueling stops and the present methodology ends.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENT

The present invention is directed towards a method of controlling the purge vapor fueling of an internal combustion engine during cold engine operation. During a cold start, fuel vapor from the fuel tank is directed to the engine for combustion. Simultaneously, a commensurate amount of injected fuel is removed from the fueling strategy such that a desired amount of total fuel is delivered to the engine. Thereafter, the engine is monitored for roughness and, if necessary, the amount of injected fuel delivered to the engine is adjusted based on dynamic crankshaft control. After exhaust gas oxygen sensor feedback becomes available, the amount of injected fuel is fine tuned.

Figure 1:
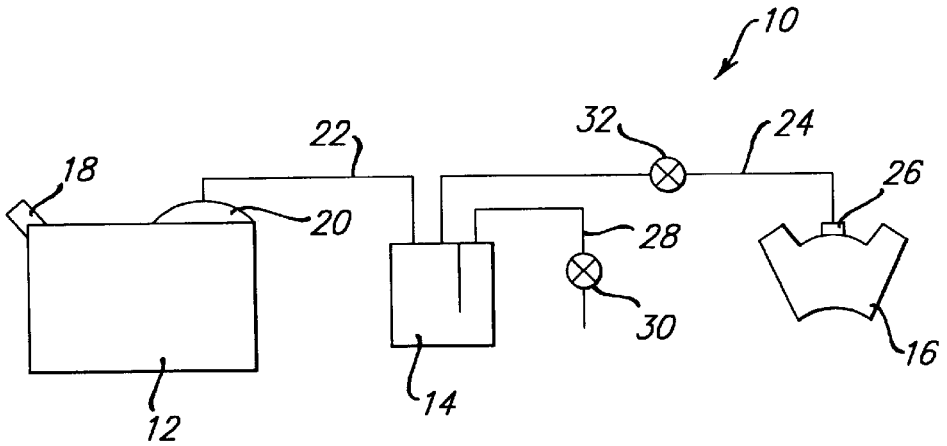
FIG. 1 is a schematic illustration of a purge vapor control system.

Turning now to the drawing figures, a fuel vapor purge control system is illustrated schematically at FIG. 1. The fuel vapor purge control system 10 includes a fuel tank 12, a fuel vapor purge canister 14, and an internal combustion engine 16. The fuel tank 12 includes a fuel fill tube 18 and a dome portion 20. The fuel tank 12 is interconnected with the fuel vapor purge canister 14 by a fuel tank vapor line 22. The fuel tank vapor line 22 is coupled to the dome portion 20 of the fuel tank 12. As is known, fuel vapors in the fuel tank 12 migrate through the tank vapor line 22 and are stored in the fuel vapor purge canister 14.

The fuel vapor purge canister 14 is interconnected with the internal combustion engine 16 by a purge vapor line 24. The purge vapor line 24 is coupled to the intake manifold 26 of the internal combustion engine 16. The fuel vapor purge canister 14 communicates with atmosphere by way of a vent line 28 coupled thereto. A canister vent valve 30 is disposed along the vent line 28 to selectively seal the fuel vapor purge canister 14 from atmosphere. A purge valve 32 is disposed along the purge vapor line 24 for selectively isolating the fuel vapor purge canister 14 and the fuel tank 12 from the internal combustion engine 16.

During normal purging operations, the canister vent valve 30 is open thereby allowing the fuel vapor purge canister 14 to communicate with atmosphere. Also, the purge valve 32, which is typically closed during operation of the internal combustion engine 16, is opened when engine operations are conducive to purging, thereby allowing the lower pressure within the intake manifold 26 to draw purge vapors from the fuel vapor purge canister 14 through the purge vapor line 24 and into the internal combustion engine 16 for combustion.

At start-up, only a small amount of fuel vapors are present in the fuel vapor purge canister 14. In fact, the vast amount of fuel vapors reside in the dome portion 20 of the fuel tank 12 at start-up. By closing the canister vent valve 30 and opening the purge valve 32 at start-up, the low pressure of the intake manifold 26 draws the fuel vapors from the dome portion 20 of the fuel tank 12 into the internal combustion engine 16. As such, this fuel vapor can be used for combustion at start-up instead of the normal injected fuel.

As more fully described in co-pending U.S. application Ser. No. 09,377,324 entitled "Purge Vapor Start Feature" to Weber et al. (99–827), which is commonly assigned to the assignee of the present invention and hereby expressly incorporated by reference herein, a methodology for controlling the above-described fuel vapor purge system includes replacing a percent of liquid injected fuel with the fuel vapor from the fuel tank at start-up. The percent of fuel to be replaced is targeted as a function of time since the start-up event.

The desired percentage of fuel vapor to be delivered is preferably the maximum amount possible as prescribed by certain limits. For instance, at idle, a minimum pulse width requirement sets the maximum limit of fuel vapors. The minimum pulse width sets the minimum amount of fuel that can be accurately injected by the fuel injectors based on the operating parameters of the engine. The fuel injectors are never completely turned off to avoid transient fuel concerns at a throttle tip-in event. During off idle conditions, a maximum rate of vapor flow from the fuel tank is the maximum limit.

The methodology also tracks the actual mass flow rate of the fuel delivered from the purge system. As the mass flow rate of fuel vapor from the fuel tank decreases (due to the change in the pressure difference between the intake manifold and the fuel tank over time), the amount of fuel required to be injected increases. After the mass flow rate of the purge fuel vapor drops below a minimum threshold, complete fuel delivery is supplied by the fuel injectors.

Figure 2:
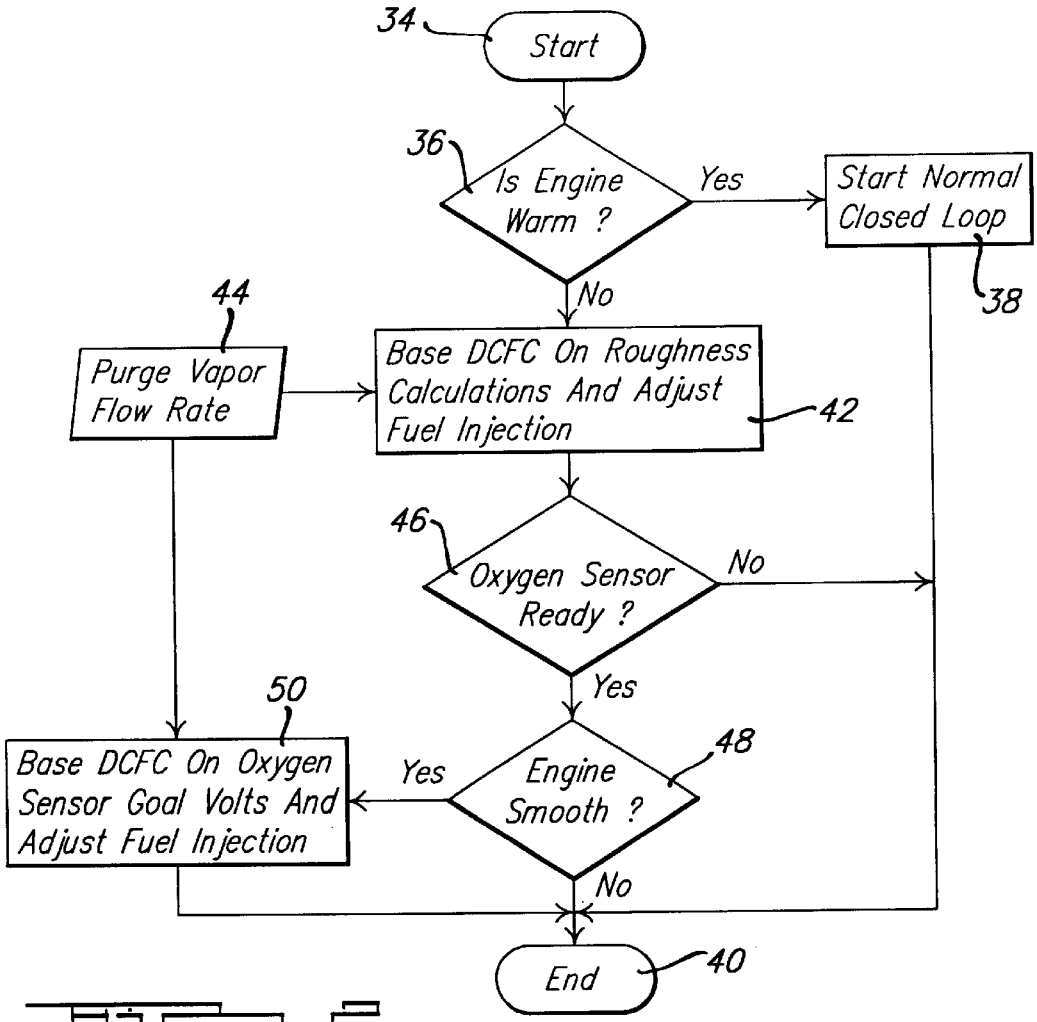
FIG. 2 is a flow chart depicting a methodology for controlling the fueling of an internal combustion engine during purge vapor fueling at start-up.

Turning now to FIG. 2, a methodology for controlling the amount of injected fuel to be supplied in conjunction with the purge vapors from the purge vapor control system is illustrated. The methodology starts in bubble 34 and falls through to decision block 36. In decision block 36, the methodology determines if the engine has reached a fully warm condition. This may be accomplished by way of a timer or may be directly measured by a temperature sensor.

If the engine is fully warm at decision block 36, start-up purge vapor fueling stops and the methodology advances to block 38. In block 38, the methodology starts normal closed loop fuel control. Normal closed loop fuel control does utilize fuel purge vapors and therefore the remainder of the present methodology is unnecessary. Therefore, from block 14, the methodology advances to bubble 40 and exits the subroutine pending a subsequent execution thereof, such as at the next start-up event.

Referring again to decision block 36, if the engine has not yet reached a fully warm condition, start-up purge vapor fueling continues and the methodology advances to block 42. In block 42, the methodology calculates a dynamic crankshaft fuel control (DCFC) fuel multiplier based on engine roughness. According to DCFC systems, if the engine is operating too rough, an adjustment in fueling can be made to smooth the engine. A more thorough description of dynamic crankshaft fuel control fuel multiplier calculations can be found in U.S. Pat. No. 5,809,969 entitled "Method for Processing Crankshaft Speed Fluctuations for Control Applications" to Fiaschetti et al., which is assigned to the common assignee of the present application and is hereby expressly incorporated by reference herein.

During the calculation of the DCFC fuel multiplier, the purge vapor flow rate from the purge vapor fuel control system is provided from data block 44. This purge vapor flow rate may be acquired, if desired, from the position of the purge valve. Based on the purge vapor flow rate, the methodology determines a current amount of fuel being injected into the engine. In block 42, the methodology adjusts the amount of fuel injected into the engine with the calculated DCFC fuel multiplier.

From block 42, the methodology advances to decision block 46. In decision block 46, the methodology determines if an exhaust gas oxygen sensor is ready by, for instance, determining if enough time has expired since start-up for the oxygen sensor to be reliable. If the oxygen sensor is not ready at decision block 46, the methodology advances to bubble 16 and exits the subroutine pending a subsequent execution thereof. However, if the oxygen sensor is deemed ready by the methodology at decision block 46, the methodology advances to decision block 48.

In decision block 48, the methodology determines if the engine is operating smoothly on the fuel vapors from the fuel purge vapor control system and the injected fuel as modified by the DCFC fuel multiplier at decision block 42. In this case, the term "smoothly" contemplates an engine roughness level which is within certain pre-selected limits, i.e., within a range of smooth operation. If the engine is not operating smoothly at decision block 48, the methodology advances to decision block 40 and exits the subroutine pending a subsequent execution thereof. However, if the engine is deemed to be running smoothly by the methodology at decision block 48, the methodology advances to block 50.

In block 50, the methodology recalculates the DCFC fuel multiplier based on the goal voltage for the exhaust gas oxygen sensor. In this way, the DCFC fuel multiplier determined at block 42 (which results in smooth engine operation at decision block 48) is fine-tuned with oxygen sensor feedback at block 50. The methodology then readjusts the amount of fuel being injected into the engine at block 50 with the updated DCFC fuel multiplier. As with the determination of the DCFC fuel multiplier at decision block 42, the recalculation of the DCFC fuel multiplier at block 50 relies in part on the purge vapor flow rate from data block 44. From block 50, the methodology advances to bubble 16 and exits the subroutine pending a subsequent execution thereof.

Thus, a fuel control system is provided for controlling the amount of fuel being injected into an internal combustion engine during fuel vapor fuelling at start-up. After start-up, the methodology tests the engine for roughness and adjusts the amount of injected fuel delivered to the engine with the fuel vapors accordingly. After oxygen sensor feedback is available, the methodology recalculates the fueling requirements. If necessary, the amount of injected fuel is readjusted. After the engine warms up, the delivery of fuel vapors stops and the present methodology ends.

Those skilled in the art can now appreciate from the foregoing description that the broad teachings of the present invention can be implemented in a variety of forms.

Therefore, while this invention has been described in connection with particular examples thereof, the true scope of the invention should not be so limited since other modifications will become apparent to the skilled practitioner upon a study of the drawings, specification, and following claims.

What is claimed is:

1. A method of controlling fuel delivery to an engine comprising:

determining a purge vapor flow rate to said engine from a purge vapor fuel control system;

determining a fuel injection rate to said engine based on said purge vapor flow rate;

determining a dynamic crankshaft fuel control multiplier based on a goal voltage of an exhaust gas oxygen sensor associated with said engine; and adjusting said fuel injection rate based on said dynamic crankshaft fuel control multiplier.

2. The method of claim 1 further comprises determining that said oxygen sensor is ready prior to said step of determining said dynamic crankshaft fuel control multiplier.

3. The method of claim 1 further comprises determining that said engine is operating within a pre-selected range of smoothness prior to said step of determining said dynamic crankshaft fuel control multiplier.

4. The method of claim 1 wherein said step of determining said purge vapor flow rate further comprises detecting a position of a purge valve of said purge vapor fuel control system.

5. The method of claim 1 wherein said purge vapor flow rate further comprises a maximum rate possible at a given engine operating condition.

6. The method of claim 1 wherein said maximum rate further comprises a minimum fuel injection rate.

7. The method of claim 1 wherein said maximum rate further comprises a maximum flow through a purge valve of said purge vapor fuel control system.

8. A method of controlling fuel delivery to an engine comprising:

determining a purge vapor flow rate to said engine from a purge vapor fuel control system;

determining a fuel injection rate to said engine based on said purge vapor flow rate;

determining a dynamic crankshaft fuel control multiplier based on engine roughness;

adjusting said fuel injection rate based on said dynamic crankshaft fuel control multiplier;

updating said dynamic crankshaft fuel control multiplier based on a goal voltage of an exhaust gas oxygen sensor associated with said engine; and re-adjusting said fuel injection rate based on said updated dynamic crankshaft fuel control multiplier.

9. The method of claim 8 further comprises determining that said oxygen sensor is ready prior to said step of updating said dynamic crankshaft fuel control multiplier.

10. The method of claim 8 further comprises determining that said engine is operating within a pre-selected range of smoothness prior to said step of updating said dynamic crankshaft fuel control multiplier.

11. The method of claim 8 wherein said step of determining said purge vapor flow rate further comprises detecting a position of a purge valve of said purge vapor fuel control system.

12. The method of claim 8 wherein said purge vapor flow rate further comprises a maximum rate possible at a given engine operating condition.

13. The method of claim 8 wherein said maximum rate further comprises a minimum fuel injection rate.

14. The method of claim 8 wherein said maximum rate further comprises a maximum flow through a purge valve of said purge vapor fuel control system.

* * * * *